US009464412B2

(12) United States Patent
Kobayashi et al.

(10) Patent No.: US 9,464,412 B2
(45) Date of Patent: Oct. 11, 2016

(54) WATER DEMAND OPTIMIZATION SYSTEM, CONTROL SYSTEM AND PROGRAM

(75) Inventors: Hisashi Kobayashi, Kawaguchi (JP); Yoshitaka Kobayashi, Kawasaki (JP); Koichi Hirooka, Yokohama (JP); Yutaka Iino, Kawasaki (JP); Masato Shibuya, Saitama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 955 days.

(21) Appl. No.: 13/550,756

(22) Filed: Jul. 17, 2012

(65) Prior Publication Data

US 2012/0323380 A1 Dec. 20, 2012

Related U.S. Application Data

(63) Continuation of application No. PCT/JP2012/064705, filed on Jun. 7, 2012.

(30) Foreign Application Priority Data

Jun. 14, 2011 (JP) ..... 2011-132701

(51) Int. Cl.
*E03B 3/00* (2006.01)
*G06Q 50/00* (2012.01)
(Continued)

(52) U.S. Cl.
CPC . *E03B 1/02* (2013.01); *E03B 3/00* (2013.01); *G06Q 50/06* (2013.01)

(58) Field of Classification Search
CPC ..... G05D 7/00; G05D 7/06; G05D 9/12; E03B 1/02; E03B 3/00; E03B 3/32; E03B 5/00; G06Q 50/06; G06Q 30/0202
USPC ..... 700/282; 705/63, 412
See application file for complete search history.

(56) References Cited

U.S. PATENT DOCUMENTS

2005/0165511 A1* 7/2005 Fairlie ..... 700/286
2006/0163165 A1* 7/2006 Frank ..... 210/739
(Continued)

FOREIGN PATENT DOCUMENTS

CN 1680766 10/2005
CN 1779711 5/2006
(Continued)

OTHER PUBLICATIONS

International Search Report in Application No. PCT/JP2012/064705, dated Sep. 18, 2012.
(Continued)

*Primary Examiner* — M. N. Von Buhr
(74) *Attorney, Agent, or Firm* — Finnegan, Henderson, Farabow, Garrett & Dunner, LLP

(57) ABSTRACT

According to one embodiment, a water demand optimization system includes a management terminal, a measuring apparatus, a demand information generating unit and a water-supply control apparatus. The management terminal drives customer equipment, which performs an operation using water, in a time zone in which a power unit rate is low. The measuring apparatus measures an amount of water used in a dwelling unit. The demand information generating unit generates water demand based on the amount of water. The water-supply control apparatus controls a pump in a manner to meet water demand and to minimize a treatment cost in a water purification plant and a cost for conveyance of clear water with reference to a variation in the power unit rate.

20 Claims, 7 Drawing Sheets

(51) Int. Cl.
*E03B 1/02* (2006.01)
*G06Q 50/06* (2012.01)

(56) References Cited

U.S. PATENT DOCUMENTS

| | | | | |
|---|---|---|---|---|
| 2007/0012628 | A1* | 1/2007 | Frank | 210/668 |
| 2007/0130053 | A1 | 6/2007 | Haji-Valizadeh | |
| 2008/0281473 | A1 | 11/2008 | Pitt | |
| 2010/0082265 | A1* | 4/2010 | Song | 702/25 |
| 2010/0312400 | A1* | 12/2010 | Steffensen | 700/282 |
| 2011/0046792 | A1* | 2/2011 | Imes et al. | 700/278 |

FOREIGN PATENT DOCUMENTS

| | | | |
|---|---|---|---|
| CN | 101858095 | | 10/2010 |
| EP | 1 270 827 | | 1/2003 |
| JP | 8-120712 | | 5/1996 |
| JP | 2001-55763 | | 2/2001 |
| JP | 2001-84039 | | 3/2001 |
| JP | 2001-288782 | A | 10/2001 |
| JP | 2002-266380 | A | 9/2002 |
| JP | 2003-85394 | | 3/2003 |
| JP | 2006-291514 | | 10/2006 |
| JP | 2007-70829 | A | 3/2007 |
| JP | 2008-67473 | | 3/2008 |

OTHER PUBLICATIONS

Notification of the First Office Action from the Intellectual Property Office of the People's Republic of China dated Feb. 8, 2014, for counterpart Chinese Patent Application No. 2012-80000530.5, and English translation thereof (34 pages total).

Wenjian, Zhu, et al., "Practical Application of Valley Filling by Shifting Peaks at Water Supply Station in Populated Area," Sep. 30, 2000. Penzhihua University Bulletin, pp. 82-84, vol. 17, No. 3.

Search and Examination Report issued on Mar. 21, 2013 by the Intellectual Property Office of Singapore for Singapore Patent Application No. 201205449-0.

International Preliminary Report on Patentability and Written Opinion issued by the International Bureau of WIPO on Jan. 3, 2014, for International Application No. PCT/JP2012/064705.

Office Action, issued from the Japanese Patent Office in corresponding Patent Application No. 2011-132701, dated Apr. 14, 2015, 6 pp.

Search Report, issued from the European Patent Office in counterpart European Application No. 12735080.9-1608/2722447 PCT/JP2012064705, dated Jun. 5, 2015, 7 pp.

* cited by examiner

WATER DEMAND OPTIMIZATION SYSTEM, CONTROL SYSTEM AND PROGRAM

CROSS-REFERENCE TO RELATED APPLICATIONS

This application is a Continuation Application of PCT Application No. PCT/JP2012/064705, filed Jun. 7, 2012 and based upon and claiming the benefit of priority from prior Japanese Patent Application No. 2011-132701, filed Jun. 14, 2011, the entire contents of all of which are incorporated herein by reference.

FIELD

Embodiments described herein relate generally to a water demand optimization system which manipulates the demand for water by customers and controls supply of clear water from a water-supply system to dwelling units, a control system which is used in the water demand optimization system, and a program which is used in a computer of this system.

BACKGROUND

In a conventional water-supply system, raw water, which is taken in from rivers, is purified in a water purification plant. Clear water is supplied to customers via a plurality of distributing reservoirs. Meanwhile, in a sewage system, waste water, which is drained by customers, is conveyed to a sewage treatment plant via a plurality of pumping stations. The waste water is subjected to sewage treatment in the sewage treatment plant, and discharged to rivers, etc.

In this manner, the water-supply system and sewage system carry out their processes according to water demand by customers.

On the other hand, customers, in many cases, use water without being conscious of energy costs. It is empirically known that two peaks of water demand occur in the morning and evening in a day. The time zones of the morning and evening, at which the peaks of water demand occur, are time zones in which the power unit rate is high.

As described above, since the time zone in which the peak of water demand occurs overlaps the time zone in which the power unit rate is high, a great deal of water has to be treated in the water-supply system and sewage system in the time zones in which the power unit rate is high. Consequently, the cost of water treatment increases.

DETAILED DESCRIPTION

In general, according to one embodiment, there is provided a water demand optimization system which produces clear water in a water purification plant from raw water which is taken in from an intake source, conveys the clear water by a pump, and supplies the clear water via a distributing reservoir to an urban area including a plurality of dwelling units. The water demand optimization system includes a management terminal, a measuring apparatus, a demand information generating unit and a water-supply control apparatus. The management terminal is provided in each of the plurality of dwelling units, and is configured to drive customer equipment, which performs an operation using water, in a time zone in which a power unit rate is low in each of the plurality of dwelling units. The measuring apparatus is provided in each of the plurality of dwelling units, and is configured to measure an amount of water used in the dwelling unit in which the measuring apparatus is provided. The demand information generating unit is configured to generate water demand information in the urban area, based on the amount of water measured by the measuring apparatus provided in each of the plurality of dwelling units. The water-supply control apparatus is configured to control the pump in a manner to meet water demand which is indicated in the water demand information and to minimize a treatment cost in the water purification plant and a cost for conveyance of the clear water with reference to a variation in the power unit rate.

First Embodiment

Figure 1:
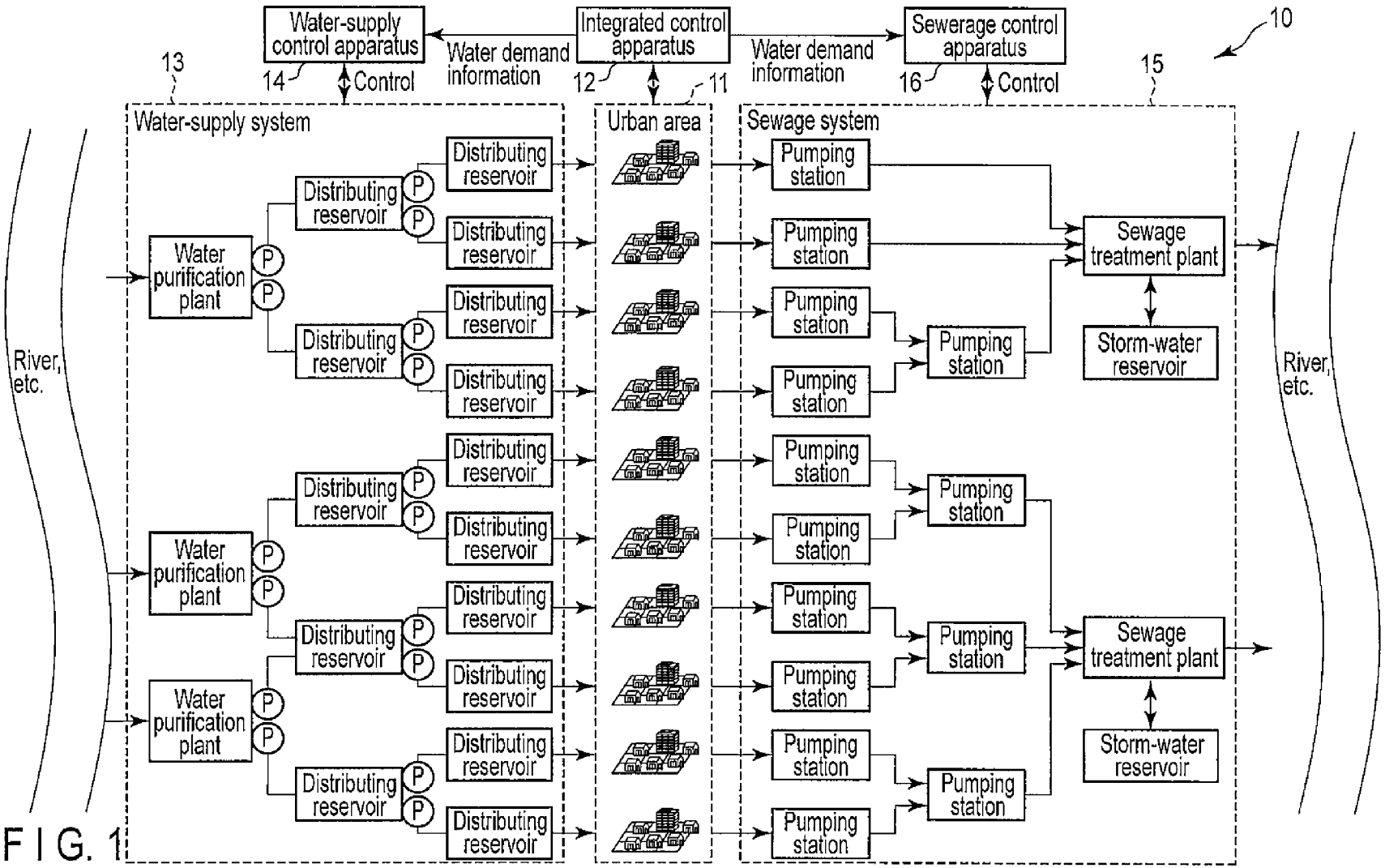
FIG. 1 is a view illustrating the configuration of a water demand optimization system according to a first embodiment.

FIG. 1 is a schematic view illustrating the configuration of a water demand optimization system 10 according to a first embodiment. The system 10 shown in FIG. 1 includes an urban area 11, a integrated control apparatus 12, a water-supply system 13, a water-supply control apparatus 14, a sewage system 15 and a sewerage control apparatus 16.

Figure 2:
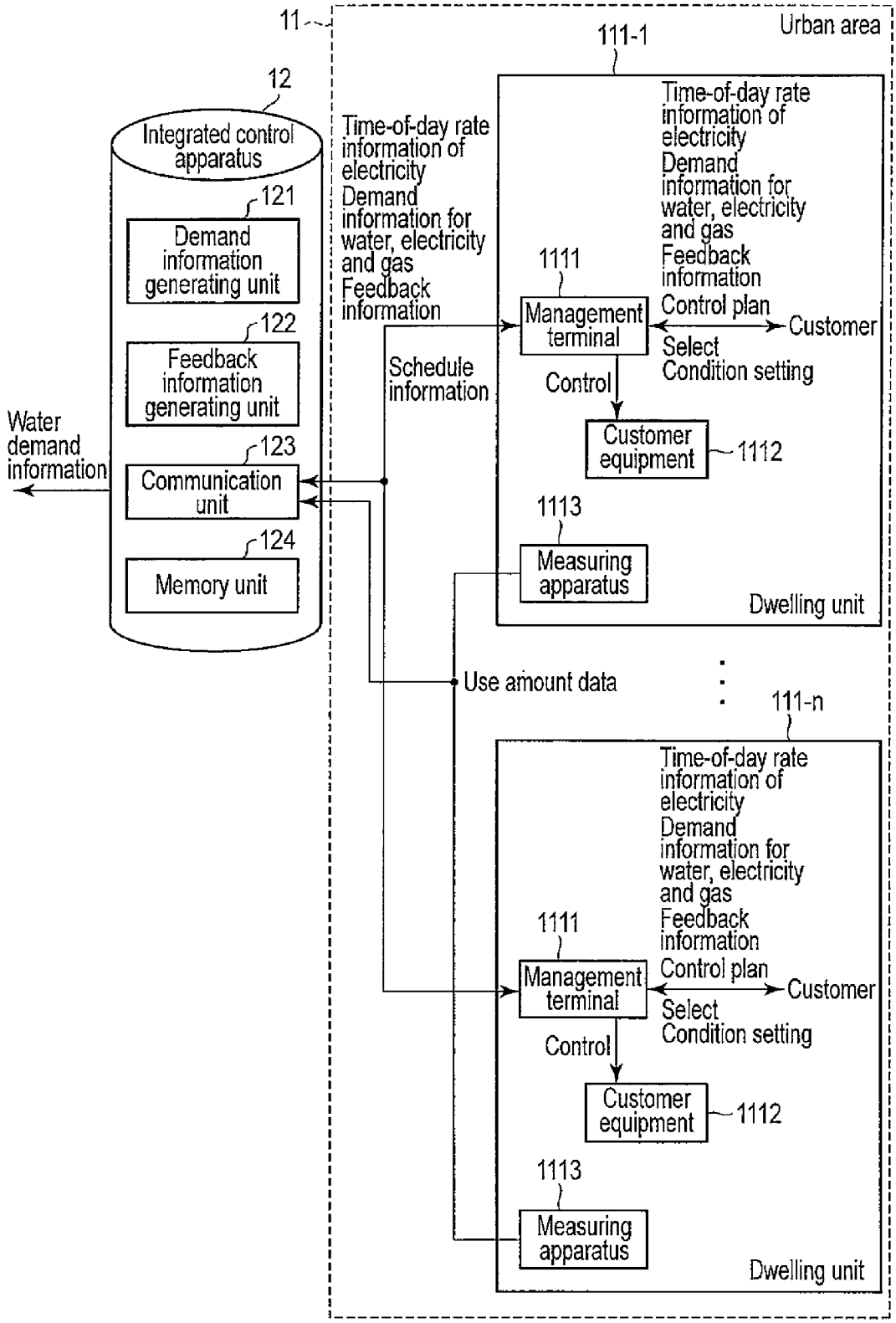
FIG. 2 is a view illustrating the configuration of an urban area and a integrated control apparatus in FIG. 1.

FIG. 2 is a schematic view illustrating the configuration of the urban area 11 and integrated control apparatus 12 according to the first embodiment. The urban area 11 shown in FIG. 2 includes a plurality of dwelling units 111-1 to **111-*n*. Since operations in the dwelling units 111-1 to 111-*n* are similar, a description is given of the dwelling unit 111-1** in this example.

In the dwelling unit 111-1, a management terminal 1111, customer equipment 1112 and a measuring apparatus 1113 are installed.

The customer equipment 1112 is equipment which is driven by using water, and includes, for instance, a bath water heater, a washing machine, and a dish washer. The customer equipment 1112 is driven according to control from the management terminal 1111.

The management terminal 1111 is an apparatus having an interactive communication function, such as a HEMS (Home Energy Management System) server, a TV, a mobile phone, a smartphone or a PC. The management terminal 1111 includes an instruction input unit with which a customer, who uses the management terminal 1111, inputs an instruction, and a display unit which displays information, etc. which is transmitted from the integrated control apparatus 12.

The management terminal 1111 receives time-of-day electricity rate information and demand information for water, electricity and gas from the integrated control apparatus 12. The management terminal 1111 displays the received information to the customer by the display unit.

In addition, the management terminal 1111 creates, based on the time-of-day electricity rate, a control plan for controlling the customer equipment 1112 so that water may be used in a time zone and by a method with a low power unit rate. The control plan includes identification information of the customer equipment 1112 and the start time for starting the operation of the customer equipment 1112. For example, the management terminal 1111 creates the control plan such that the bath water heater is driven from 22:00 at which a power unit rate is low. The management terminal 1111 displays the created control plan to the customer from the display unit. Incidentally, the number of control plans, which are to be created by the management terminal 111, may be single or plural.

If the displayed control plan is selected by the customer through the instruction input unit, the management terminal 111 sets the selected control plan as scheduled control. When a start time, which is designated by the scheduled control, has come, the management terminal 1111 starts the operation of equipment which is designated by the scheduled control. In addition, if scheduled control is set, the management terminal 1111 notifies the integrated control apparatus 12 of the information relating to the scheduled control as schedule information.

Figure 3:
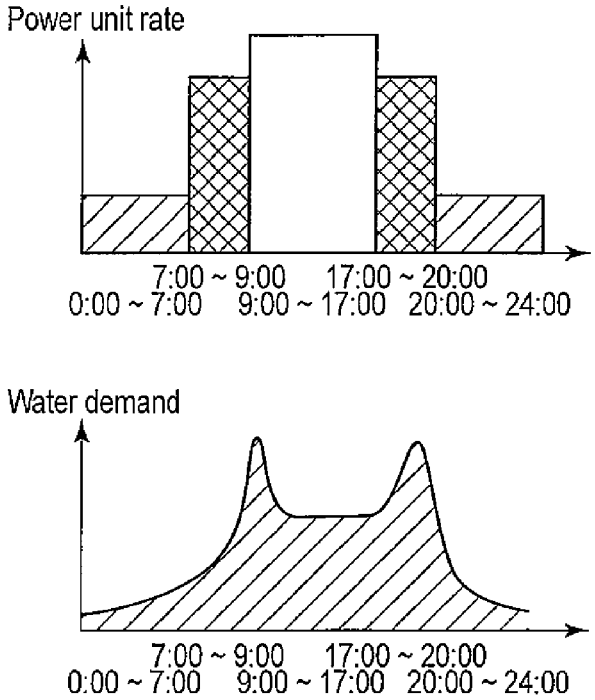
FIG. 3 is a view illustrating a relationship between a transition of a power unit rate and a transition of water demand.

As described above, since the management terminal 1111 activates the customer equipment 1112 by avoiding a time zone in which a power unit rate is high, the electricity rate can be reduced. FIG. 3 is a view illustrating a relationship between a transition of a power unit rate and a transition of water demand. As illustrated in FIG. 3, in general, a time zone in which water demand is highest substantially coincides with a time zone in which an electricity unit rate is high. The management terminal 1111 controls water demand by activating the equipment which uses water by avoiding a time zone in which a power unit rate is high. Thereby, the management terminal 1111 can realize a peak shift of water demand and a peak cut of water demand.

In the meantime, the management terminal 1111 may receive a request from a customer and may set scheduled control so as to meet the received request. For example, the customer inputs a request to the management terminal 1111 so that the bath is heated by 19:00 by the bath water heater which is involved in the customer equipment 1112. The management terminal 1111 sets scheduled control so as to control the bath water heater according to the request from the customer. In addition, the customer inputs a request to the management terminal 111 so that washing/drying is completed by 7:00 in the morning, avoiding the midnight, by the washing machine which is involved in the customer equipment 1112. The management terminal 1111 sets scheduled control so as to control the washing machine according to the request from the customer.

In addition, the management terminal 1111 receives, from the integrated control apparatus 12, feedback information which is generated by the integrated control apparatus 12, based on the result of use of water, electricity and gas. The feedback information includes, for instance, a power-saving effect which occurs by shifting the time points of use of water, electricity and gas. The management terminal 1111 displays the received feedback information to the customer by the display unit.

The measuring apparatus 1113 is, for example, a smartmeter, and measures the amount of use of water, electricity and gas in the dwelling unit 111-1. The measuring apparatus 1113 outputs the measured amount of use to the integrated control apparatus 12 as use amount data.

The integrated control apparatus 12 includes a demand information generating unit 121, a feedback information generating unit 122, a communication unit 123 and a memory unit 124.

The memory unit 124 stores time-of-day electricity rate information which is set in advance, and use amount data which is output from the measuring apparatuses 1113 installed in the dwelling units 111-1 to **111-*n***.

The demand information generating unit 121 generates demand information for water, electricity and gas, by taking statistics of the use amount data stored in the memory unit 124. The demand information has such a format that the transition of demand can comprehensively be confirmed, for example, like a transition of demand in respective time zones in a day. The demand information generating unit 121 transmits, by the communication unit 123, the generated demand information for water, electricity and gas to the management terminals 1111 installed in the dwelling units 111-1 to **111-*n*. In addition, the demand information generating unit 121 transmits, by the communication unit 123, the generated demand information for water to the water-supply control apparatus 14 and sewerage control apparatus 16. In the meantime, the demand information generating unit 121 may update the generated demand information for water, electricity and gas, taking into account the schedule information which is set by the management terminals 1111 of the dwelling units 111-1 to 111-*n***, and may output the updated information as new demand information.

The feedback information generating unit 122 generates feedback information of each of the dwelling units 111-1 to **111-*n*, based on the use amount data from the measuring apparatus 1113 installed in each dwelling unit, 111-1 to 111-*n***.

For example, the feedback information generating unit 122 compares the time points of use of water, electricity and gas, which are included in the use amount data, and general time points of use of water, electricity and gas. The feedback information generating unit 122 generates, as feedback information, for example, a power-saving effect which is obtained by shifting the time points of use of water, electricity and gas, taking into account the amount of use of water and electricity, in relation to the variation of a power unit rate due to the variation of time points of use.

The communication unit 123 transmits the time-of-day electricity rate information, which is stored in the memory unit 124, to the management terminals 1111 installed in the dwelling units 111-1 to **111-*n*. In addition, the communication unit 123 transmits the demand information for water, electricity and gas, which has been generated by the demand information generating unit 121, to the management terminals 1111 installed in the dwelling units 111-1 to 111-*n*. The communication unit 123 also transmits the demand information for water to the water-supply control apparatus 14 and sewerage control apparatus 16. Besides, the communication unit 123 transmits the feedback information, which has been generated by the feedback information generating unit 122 in connection with each of the dwelling units 111-1 to 111-*n***, to the associated dwelling unit.

Figure 4:
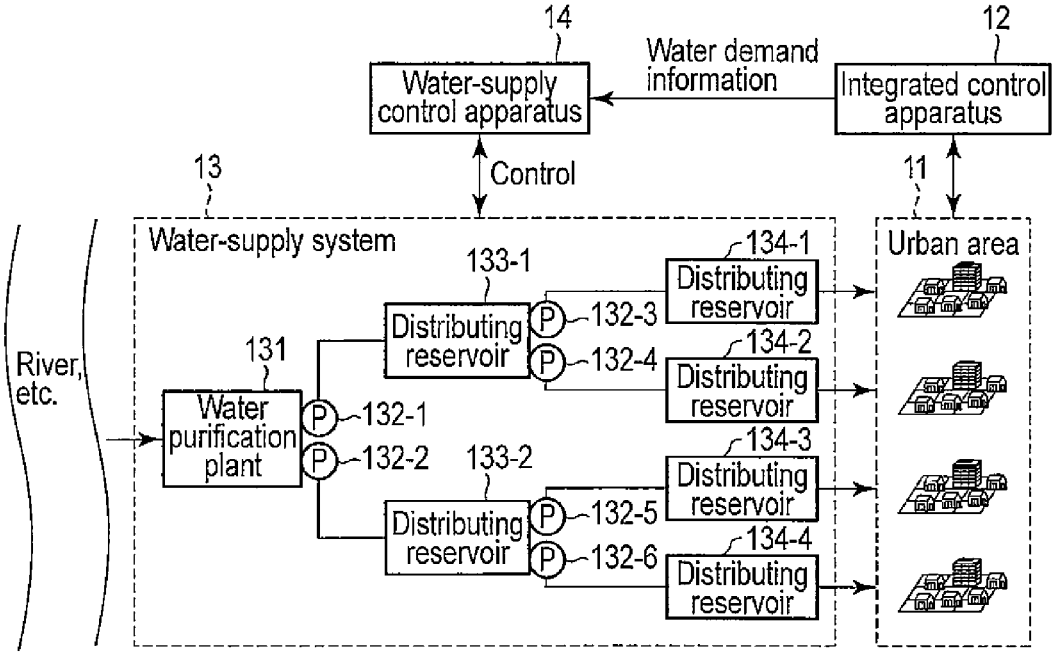
FIG. 4 is a view illustrating the configuration of a water-supply system and a water-supply control apparatus in FIG. 1.

FIG. 4 is a schematic view illustrating the configuration of the water-supply system 13 and water-supply control apparatus 14 according to the first embodiment.

The water-supply system 13 shown in FIG. 4 includes a water purification plant 131, conveying pumps 132-1 to 132-6, first distributing reservoirs 133-1 and 133-2, and second distributing reservoirs 134-1 to 134-4.

The water purification plant 131 takes in raw water from an intake source such as a river or groundwater, and produces clear water by using a plurality of water-purifying equipment in the water purification plant 131. The clear water produced in the water purification plant 131 is conveyed to the distributing reservoirs 133-1 and 133-2 by the conveying pumps 132-1 and 132-2. In addition, the clear water, which has been conveyed to the distributing reservoir 133-1, is conveyed to the distributing reservoirs 134-1 and 134-2 by the conveying pumps 132-3 and 132-4. The clear water, which has been conveyed to the distributing reservoir 133-2, is conveyed to the distributing reservoirs 134-3 and 134-4 by the conveying pumps 132-5 and 132-6. The clear water, which is pooled in the distributing reservoirs 134-1 to 134-4, is supplied to the urban area 11 according to demand from the urban area 11.

The water-supply control apparatus 14 receives demand information for water, which is generated by the demand information generating unit 121 included in the integrated control apparatus 12. Based on the received demand information for water and the time-of-day electricity rate, the water-supply control apparatus 14 controls the conveying pumps 132-1 to 132-6 so as to meet the water demand of the urban area 11 and to minimize the cost for production of clear water in the water purification plant 131 and the cost for the process of conveying the clear water.

In order to reduce the cost for producing clear water in the water purification plant 131, it is effective to smooth the amount of production of clear water, regardless of the variation of water demand. The reason for this is that high costs are required for maintaining the equipment that is adjusted to peaks of water demand. The water-supply control apparatus 14 controls the conveying pumps 132-1 to 132-6 so that the impoundment ratio of the distributing reservoirs 133-1, 133-2, and 134-1 to 134-4 may have a value that is suited to smooth the amount of production of clear water. In addition, when an increase in water demand is expected, the water-supply control apparatus 14 may control the conveying pumps 132-1 to 132-6, thereby to adjust the impoundment ratio of the distributing reservoirs 133-1, 133-2 and 134-1 to 134-4, to increase the production of clear water in time zones in which a power unit rate is low, and to prepare for an increasing water demand.

In addition, in order to lower the cost for the process of conveying clear water, it is effective to drive the conveying pumps 132-1 to 132-6 which consume high power, in time zones in which the power unit rate is low. Specifically, the water conveying cost can efficiently be reduced if clear water is conveyed to the distributing reservoirs 134-1 to 134-4 near customers, while the power unit rate is low.

Besides, based on the received demand information for water and the time-of-day electricity rate, the water-supply control apparatus 14 may control the conveying pumps 132-1 to 132-6 so as to meet the water demand of the urban area 11 and to minimize the power consumption at the time of the peak of the power unit rate.

Figure 5:
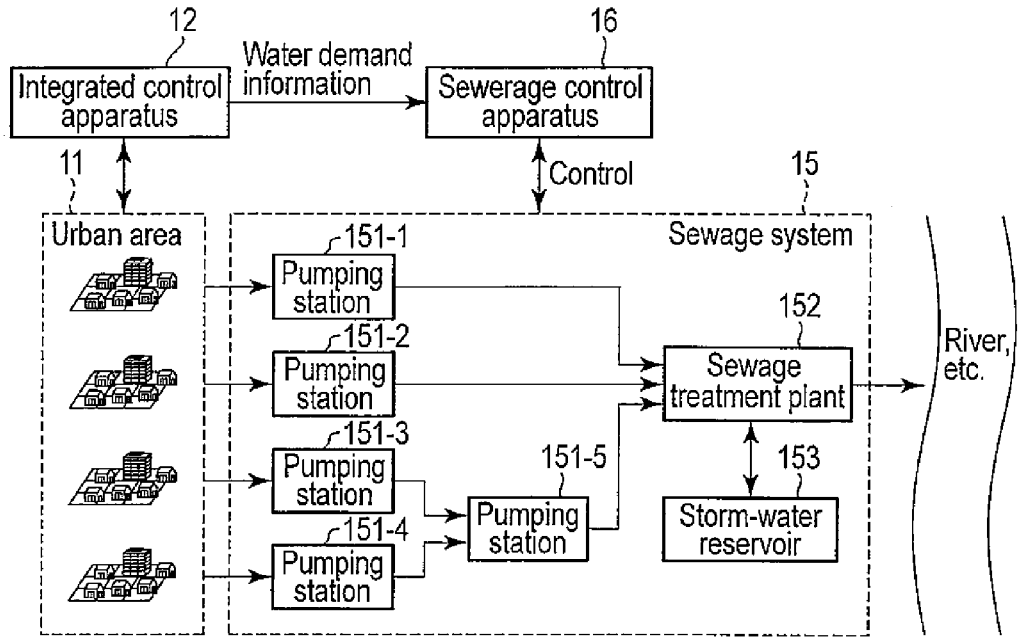
FIG. 5 is a view illustrating the configuration of a sewage system and a sewerage control apparatus in FIG. 1.

FIG. 5 is a schematic view illustrating the configuration of the sewage system 15 and sewerage control apparatus 16 according to the first embodiment.

The sewage system 15 shown in FIG. 5 includes pumping stations 151-1 to 151-5, a sewage treatment plant 152 and a storm-water reservoir 153.

Waste water, which is drained from the urban area 11, is conveyed to the sewage treatment plant 152 via the pumping stations 151-1 to 151-5. The sewage treatment plant 152 treats the waste water by using a plurality of sewage treatment equipment, and discharges the waste water to the river or sea.

The sewerage control apparatus 16 receives demand information for water, which is generated by the demand information generating unit 121 of the integrated control apparatus 12. Based on the received demand information and the time-of-day electricity rate, the sewerage control apparatus 16 controls the pumping stations 151-1 to 151-5 and storm-water reservoir 153 so as to minimize the process cost in the sewage treatment plant 152.

In order to minimize the cost of the sewage treatment in the sewage treatment plant 152, it is effective to smooth the amount of sewage treatment, regardless of the variation of water demand. The reason for this is that high costs are required for maintaining the equipment that is adjusted to peaks of water demand. The sewerage control apparatus 16 controls the pumping stations 151-1 to 151-5 and the gate of the storm-water reservoir 153, etc. so that the impoundment ratios of the pumping stations 151-1 to 151-5 and storm-water reservoir 153 may have a value that is suited to smooth the amount of sewage treatment.

In addition, based on the received demand information and the time-of-day electricity rate, the sewerage control apparatus 16 may control the pumping stations 151-1 to 151-5 and storm-water reservoir 153, so as to minimize the power consumption at the time of the peak of the power unit rate.

Next, the control operation of the water-supply system 13 by the integrated control apparatus 12 and water-supply control apparatus 14 included in the water demand optimization system 10 having the above-described structure is described according to the process procedure of the integrated control apparatus 12 and water-supply control apparatus 14.

Figure 6:
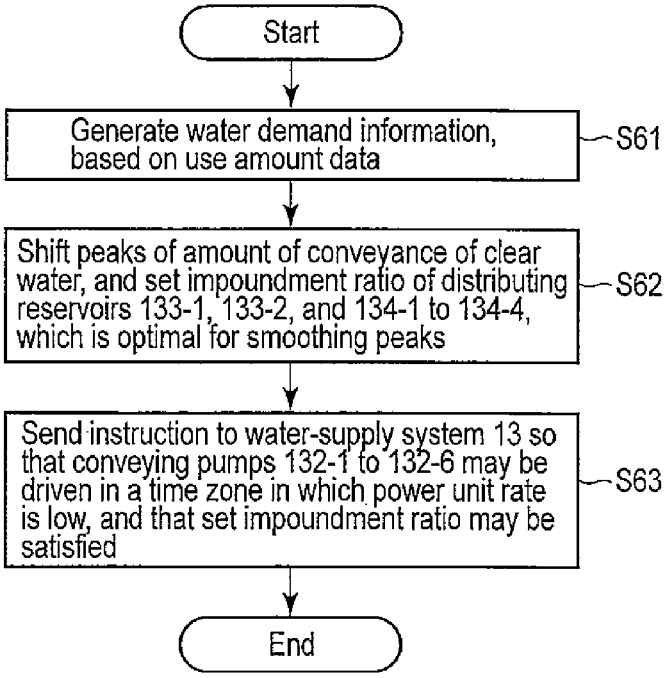
FIG. 6 is a flow chart illustrating a process at a time when the integrated control apparatus and water-supply control apparatus in FIG. 1 control the water-supply system.

FIG. 6 is a flow chart illustrating an example of a process at a time when the integrated control apparatus 12 and water-supply control apparatus 14 control the water-supply system 13.

To start with, the integrated control apparatus 12 generates demand information for water, based on the use amount data which is output from the measuring apparatuses 1113 installed in the dwelling units 111-1 to **111-*n* (step S61**).

Based on the water demand indicated by the demand information for water, which has been generated by the integrated control apparatus 12, and the time-of-day electricity rate, the water-supply control apparatus 14 sets the impoundment ratio of the distributing reservoirs 133-1, 133-2, and 134-1 to 134-4, which is optimal for shifting peaks of the amount of conveyance of clear water and smoothing the peaks (step S62).

The water-supply control apparatus 14 sends an instruction to the water-supply system 13 so that the conveying pumps 132-1 to 132-6 may be driven in a time zone of 0:00 to 7:00 or in a time zone of 20:00 to 24:00, which are time zones in which the power unit rate is low, and that the set impoundment ratio may be satisfied (step S63).

Next, the control operation of the sewage system 15 by the integrated control apparatus 12 and sewerage control apparatus 16 included in the water demand optimization system 10 having the above-described structure is described according to the process procedure of the control apparatus 12 and sewerage control apparatus 16.

Figure 7:
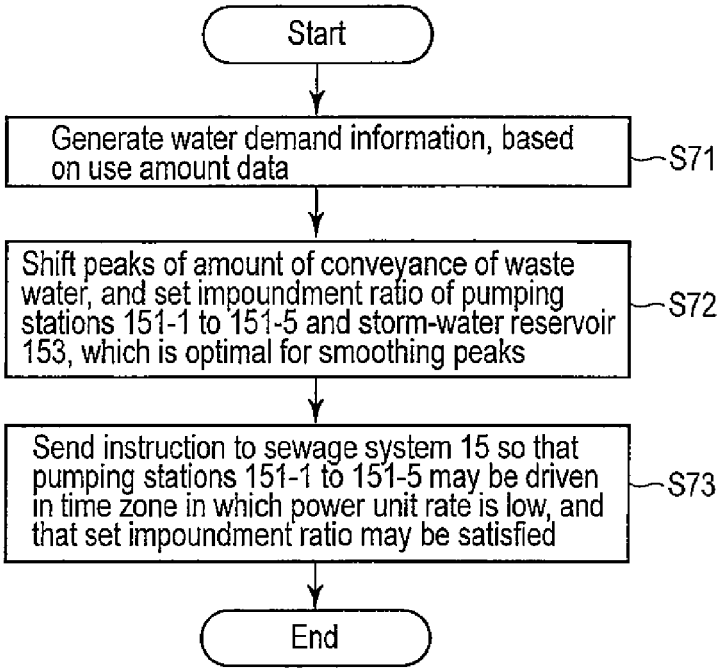
FIG. 7 is a flow chart illustrating a process at a time when the integrated control apparatus and sewerage control apparatus in FIG. 1 control the sewage system.

FIG. 7 is a flow chart illustrating an example of a process at a time when the integrated control apparatus 12 and sewerage control apparatus 16 control the sewage system 15.

To start with, the integrated control apparatus 12 generates demand information for water, based on the use amount data which is output from the measuring apparatuses 1113 installed in the dwelling units 111-1 to **111-*n* (step S71**).

Based on the amount of waste water drained from the urban area 11, which are obtained based on the water demand information generated by the integrated control apparatus 12, and the time-of-day electricity rate, the sewerage control apparatus 16 sets the impoundment ratio of the pumping stations 151-1 to 151-5 and storm-water reservoir 153, which is optimal for shifting peaks of the amount of conveyance of waste water and smoothing the peaks (step S72).

The sewerage control apparatus 16 sends an instruction to the sewage system 15 so that the pumping stations 151-1 to 151-5 may be driven in a time zone of 0:00 to 7:00 or in a time zone of 20:00 to 24:00, which are time zones in which the power unit rate is low, and that the set impoundment ratio may be satisfied (step S73).

As has been described above, in the first embodiment, the management terminal 1111 controls the customer equipment 1112 so that water may be used in a time zone and by a method with a low power unit rate, based on the time-of-day electricity rate. Thereby, the peaks of water demand in each dwelling unit are shifted, and the peaks of water demand are smoothed in accordance with this peak shift.

The integrated control apparatus 12 generates demand information for water, based on the data of the amount of use of water in the dwelling units 111-1 to **111-*n*, and sends the generated demand information to the water-supply apparatus 14 and sewerage control apparatus 16. Thereby, the demand information for water, in which the peak shift and peak smoothing of water demand in the urban area 11 are taken into account, is sent to the water-supply apparatus 14 and sewerage control apparatus 16**.

Based on the received demand information and the time-of-day electricity rate, the water-supply control apparatus 14 controls the conveying pumps 132-1 to 132-6 so as to meet the water demand of the urban area 11 and to minimize the cost for production of clear water in the water purification plant 131 and the cost for the process of conveying the clear water. Since the water-supply control apparatus 14 shifts and smoothes the peaks of the amount of conveyance of clear water in the water-supply system 13, based on the peak-shifted and peak-smoothed water demand in the urban area 11, the peak shift and peak smoothing of the amount of conveyance of clear water can be performed more effectively. Accordingly, the cost for production of clear water and the cost for the process of conveying the clear water can be reduced. In addition, in the water-supply system 13, the scale of the plant and the process stress of equipment are designed with reference to the process amount at a peak time, so that no overflow occurs in the process even at the peak time of water demand. Thus, the cost for introducing the water-supply system 13 can be reduced.

Therefore, according to the water demand optimization system 10 of this embodiment, the water demand in the urban area 11 is peak-shifted and flattened, and the amount of conveyance of clear water in the water-supply system 13 is peak-shifted and flattened. Thus, it is possible to reduce the cost for production of clear water, the cost for the process of conveying clear water, and the cost for introducing the water-supply system 13.

In addition, in the first embodiment, based on the received demand information for water and the time-of-day electricity rate, the sewerage control apparatus 16 controls the pumping stations 151-1 to 151-5 and storm-water reservoir 153. Since the sewerage control apparatus 16 shifts and smoothes the peaks of the amount of treatment of waste water in the sewage system 15, based on the peak-shifted and peak-smoothed water demand in the urban area 11, the peak shift and peak smoothing of the amount of treatment of waste water can be performed more effectively. Accordingly, the cost for treatment of waste water can be reduced. In addition, in the sewage system 15, the scale of the plant and the process stress of equipment are designed with reference to the process amount at a peak time, so that no overflow occurs in the process even at the peak time of water demand. Thus, the cost for introducing the sewage system 15 can be reduced.

Therefore, according to the water demand optimization system 10 of this embodiment, the water demand in the urban area 11 is peak-shifted and flattened, and the amount of treatment of waste water in the sewage system 15 is peak-shifted and flattened. Thus, it is possible to reduce the cost for sewage treatment and the cost for introducing the sewage system 15.

In the first embodiment, the time-of-day electricity rate and the demand information for water, electricity and gas are displayed to the customer by the display unit of the management terminal 1111. It is thinkable that the customer, who views this display, uses water by avoiding a time zone in which the power unit rate is high. Specifically, even in the case where there is equipment which cannot be controlled by the management terminal 1111, the customer may be prompted to use water by avoiding a time zone in which the power unit rate is high. Thereby, in each dwelling unit, the peak shift and peak smoothing of water demand can be performed more effectively.

In the first embodiment, the feedback information is displayed on the display unit of the management terminal 1111. The customer, who views this display, can confirm, for example, the power-saving effect which has occurred by his/her own effort, and it is thinkable that the customer becomes conscious of using water by avoiding a time zone in which the power unit rate is high. Thereby, in each dwelling unit, the peak shift and smoothing of water demand can be performed more effectively.

In the first embodiment, the demand information generating unit 121 updates the generated demand information for water, electricity and gas, taking into account the schedule information which is set by the management terminals 1111 of the dwelling units 111-1 to **111-*n***. Thereby, it is possible to provide the demand information for water, electricity and gas, in which the schedule conditions in other dwelling units are reflected.

The first embodiment is not limited to the above-described contents.

For example, the integrated control apparatus 12 may transmit to the management terminal 1111 the cumulative use amounts of water, electricity and gas, in addition to the time-of-day electricity rate information and the demand information for water, electricity and gas. At this time, the management terminal 1111 creates a control plan of the customer equipment 1112 so that water may be used in a time zone and by a method with low costs of water, electricity and gas, based on the time-of-day electricity rate information and the cumulative use amounts of water, electricity and gas. In addition, the management terminal 1111 displays on the display unit the cumulative use amounts of water, electricity and gas, in addition to the time-of-day electricity rate information and the demand information for water, electricity and gas.

It is possible that the unit rates of water, electricity and gas vary according to the cumulative use amounts of water, electricity and gas. In such a case, by creating the control plan by also taking into account the cumulative use amounts of water, electricity and gas, the utility rates of water, electricity and gas in each dwelling unit can be reduced. In addition, by displaying the cumulative use amounts of water, electricity and gas on the display unit of the management terminal 1111, the customer can be prompted to take an action to reduce the utility rate of water, electricity and gas.

The control plan, which is created by the management terminal 1111, may include, for example, the power-saving effect which is expectable when each control plan is adopted. Thereby, the customer can select a control plan which is more advantageous in peak shift and smoothing of water demand. In short, in each dwelling unit, the peak shift and smoothing of water demand can be performed more effectively.

In the first embodiment, the case, in which the management terminal 1111, customer equipment 1112 and measuring apparatus 1113 are independently present in each dwelling unit 111, has been described by way of example. However, the embodiment is not limited to this example. For example, the management terminal 1111, customer equipment 1112 and measuring apparatus 1113 may be configured as an integral unit.

In the first embodiment, the description has been given of the case in which the management terminal 1111 receives from the integrated control apparatus 12 the time-of-day electricity rate and the demand information for water, electricity and gas, and displays them. However, the management terminal 1111 may receive the total use amount of water, electricity and gas at the present time, and may display it. In this case, the demand information generating unit 121 integrates the use amount data at the present time, calculates the total use amount of water, electricity and gas, and transmits the total use amount from the communication unit 123 to the management terminal 1111. It is thinkable that the customer, who views the display of the total use amount of water, electricity and gas at the present time, avoids the use of water in the time zone in which the total use amount of water is large, thereby to shift and smooth the peaks of water demand. Thereby, in each dwelling unit, the peak shift and smoothing of water demand can be performed more effectively.

Figure 8:
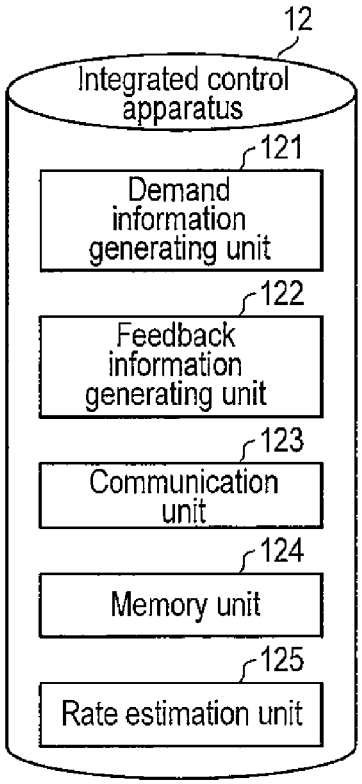
FIG. 8 is a view illustrating another example of the functional configuration of the integrated control apparatus in FIG. 1.

In the first embodiment, as shown in FIG. 3, the description has been given, by way of example, of the case in which the power unit rate is predetermined in each time zone. However, the embodiment is not limited to the case in which the time-of-day electricity rate is predetermined, for example, by the day before, and it is possible to adopt an RTP (Real Time Pricing) in which the power unit rate dynamically varies depending on the demand/supply balance of electricity. In this case, the integrated control apparatus 12 further includes a rate estimation unit 125 as shown in FIG. 8. The rate estimation unit 125 acquires the electricity demand/supply balance from the use amount data from the measuring apparatuses 1113 installed in the dwelling units 111-1 to **111-*n***, and estimates the power unit rate, based on the acquired demand/supply balance.

The demand information generating unit 121 reads out from the memory unit 124 the use amount data in the situation in which a power unit rate, which is equal or similar to the estimated power unit rate, is set. The demand information generating unit 121 generates demand information for water, electricity and gas, by taking statistics of the use amount data that has been read out.

The communication unit 123 transmits the estimated power unit rate and the generated demand information for water, electricity and gas to the management terminals 1111 installed in the dwelling units 111-1 to **111-*n*. In addition, the communication unit 123 transmits the generated demand information for water to the water-supply control apparatus 14 and sewerage control apparatus 16**.

Thereby, even when the power unit rate is determined by the RTP, the integrated control apparatus 12 can achieve peak shift and flattening of water demand. In addition, even when the power unit rate is determined by the RTP, the water-supply control apparatus 14 can achieve peak shift and flattening of the amount of conveyance of clear water in the water-supply system 13. It is thus possible to reduce the cost for production of clear water in the water-supply system 13, the cost for the process of conveying clear water, and the cost for introducing the water-supply system 13. Moreover, even when the power unit rate is determined by the RTP, the sewerage control apparatus 16 can achieve peak shift and flattening of the amount of waste water. It is thus possible to reduce the cost for sewage treatment and the cost for introducing the sewage system 15.

Second Embodiment

In a second embodiment, a description is given of a case in which the unit rate of water also varies.

Figure 9:
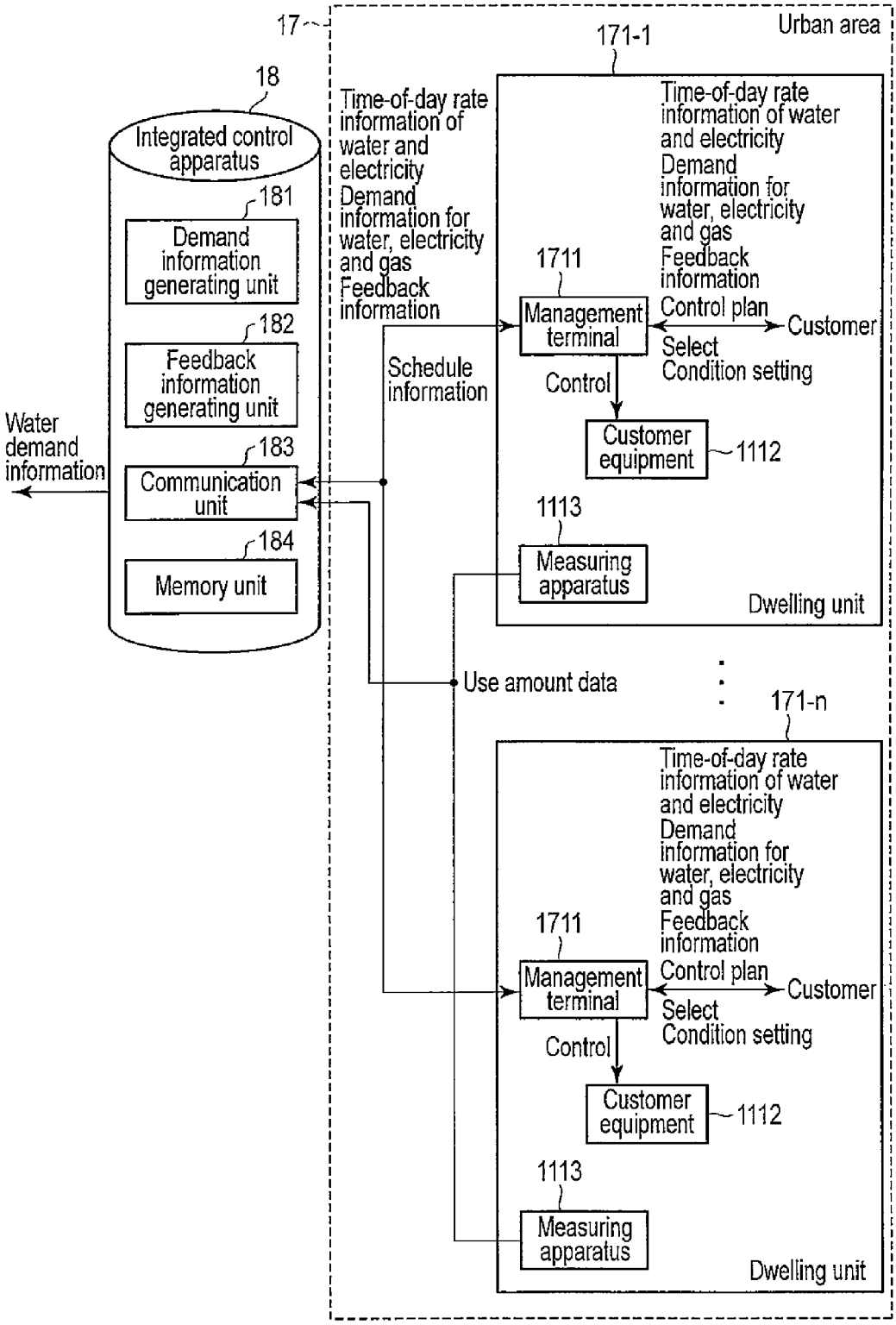
FIG. 9 is a view illustrating the configuration of an urban area and a integrated control apparatus according to a second embodiment.

FIG. 9 is a schematic view illustrating the configuration of an urban area 17 and a integrated control apparatus 18 according to the second embodiment. The urban area 17 shown in FIG. 9 includes a plurality of dwelling units 171-1 to **171-*n*. Since operations in the dwelling units 171-1 to 171-*n* are similar, a description is given of the dwelling unit 171-1** in this example.

In the dwelling unit 171-1, a management terminal 1711, customer equipment 1112 and a measuring apparatus 1113 are installed.

The management terminal 1711 is an apparatus having an interactive communication function, such as a HEMS server, a TV, a mobile phone, a smartphone or a PC. The management terminal 1711 includes an instruction input unit with which a customer, who uses the management terminal 1711, inputs an instruction, and a display unit which displays information, etc. which is transmitted from the integrated control apparatus 18.

The management terminal 1711 receives time-of-day rate information of water and electricity and demand information for water, electricity and gas from the integrated control apparatus 18. The management terminal 1711 displays the received information to the customer by the display unit.

Figure 10:
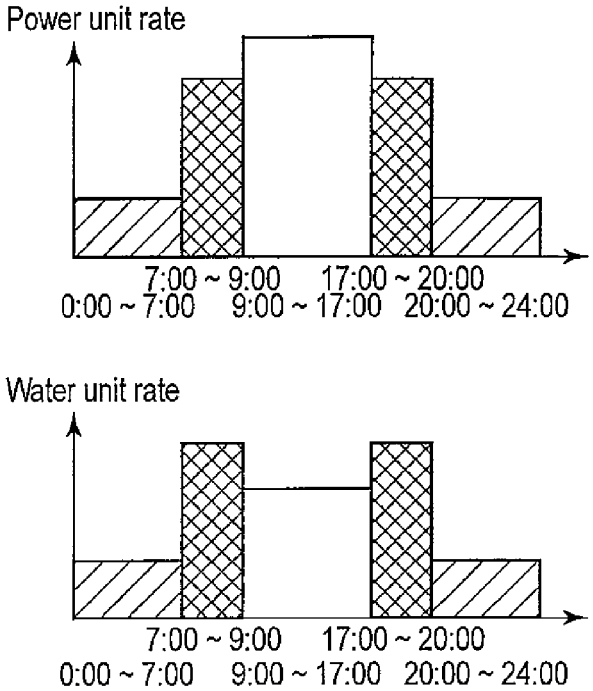
FIG. 10 is a view illustrating a relationship between a transition of a power unit rate and a transition of water unit rate.

In addition, the management terminal 1711 creates, based on the time-of-day rate information of water and electricity, a control plan for controlling the customer equipment 1112 so that water may be used in a time zone and by a method with a low water unit rate and a low power unit rate. The control plan includes identification information of the customer equipment 1112 and the start time for starting the operation of the customer equipment 1112. FIG. 10 is a view illustrating a relationship between a transition of a power unit rate and a transition of a water unit rate. For example, the management terminal 1711 creates the control plan such that the bath water heater is driven from 22:00 at which the power unit rate and water unit rate are low. The management terminal 1711 displays the created control plan to the customer from the display unit.

If the displayed control plan is selected by the customer through the instruction input unit, the management terminal 1711 sets the selected control plan as scheduled control. When a start time, which is designated by the scheduled control, has come, the management terminal 1711 starts the operation of equipment which is designated by the scheduled control. In addition, if scheduled control is set, the management terminal 1711 notifies the integrated control apparatus 18 of the information relating to the scheduled control as schedule information.

As described above, since the management terminal 1711 activates the customer equipment 1112 by avoiding a time zone in which a water unit rate and a power unit rate are high, the electricity rate and water rate can be reduced. In addition, water demand is also controlled, and a peak shift of water demand and a peak cut of water demand can be realized.

In the meantime, the management terminal 1711 may receive a request from a customer and may set scheduled control so as to meet the received request.

In addition, the management terminal 1711 receives, from the integrated control apparatus 18, feedback information which is generated by the integrated control apparatus 18, based on the result of use of water, electricity and gas. The feedback information includes, for instance, a power-saving effect and a water-saving effect, which occur by shifting the time points of use of water, electricity and gas. The management terminal 1711 displays the received feedback information to the customer by the display unit.

The integrated control apparatus 18 includes a demand information generating unit 181, a feedback information generating unit 182, a communication unit 183 and a memory unit 184.

The memory unit 184 stores time-of-day rate information of water and electricity, which is set in advance, and use amount data which is output from the measuring apparatuses 1113 installed in the dwelling units 171-1 to **171-*n***.

The demand information generating unit 181 generates demand information for water, electricity and gas, by taking statistics of the use amount data stored in the memory unit 184. The demand information has such a format that the transition of demand can comprehensively be confirmed, for example, like a transition of demand in respective time zones in a day. The demand information generating unit 181 transmits, by the communication unit 183, the generated demand information for water, electricity and gas to the management terminals 1711 installed in the dwelling units 171-1 to **171-*n*. In addition, the demand information generating unit 181 transmits, by the communication unit 183, the generated demand information for water to the water-supply control apparatus 14 and sewerage control apparatus 16. In the meantime, the demand information generating unit 181 may update the generated demand information for water, electricity and gas, taking into account the schedule information which is set by the management terminals 1711 of the dwelling units 171-1 to 171-*n***, and may output the updated information as new demand information.

The feedback information generating unit 182 generates feedback information of each of the dwelling units 171-1 to **171-*n*, based on the use amount data from the measuring apparatus 1113 installed in each dwelling unit, 171-1 to 171-*n***.

For example, the feedback information generating unit 182 compares the time points of use of water, electricity and gas, which are included in the use amount data, and general time points of use of water, electricity and gas. The feedback information generating unit 182 generates, as feedback information, for example, a power-saving effect and a water-saving effect, which are obtained by shifting the time points of use of water, electricity and gas, taking into account the amount of use of water and electricity, in relation to the variations of a water unit rate and a power unit rate due to the variation of time points of use.

The communication unit 183 transmits the time-of-day rate information of water and electricity, which is stored in the memory unit 184, to the management terminals 1711 installed in the dwelling units 171-1 to **171-*n*. In addition, the communication unit 183 transmits the demand information for water, electricity and gas, which has been generated by the demand information generating unit 181, to the management terminals 1711 installed in the dwelling units 171-1 to 171-*n*. The communication unit 183 also transmits the demand information for water to the water-supply control apparatus 14 and sewerage control apparatus 16. Besides, the communication unit 183 transmits the feedback information, which has been generated by the feedback information generating unit 182 in connection with each of the dwelling units 171-1 to 171-*n***, to the associated dwelling unit.

As has been described above, in the second embodiment, the management terminal 1711 controls the customer equipment 1112 so that water may be used in a time zone and by a method with a low water unit rate and a low power unit rate, based on the time-of-day rate information of water and electricity. Thereby, the peaks of water demand in each dwelling unit are shifted in a manner to deviate from the peaks of the water unit rate and power unit rate, and the peaks of water demand are smoothed in accordance with this peak shift. In addition, the water use rate and electricity use rate in each dwelling unit can be reduced.

The integrated control apparatus 18 generates demand information for water, based on the data of the amount of use of water in the dwelling units 171-1 to **171-*n*, and sends the generated demand information to the water-supply apparatus 14 and sewerage control apparatus 16. Thereby, the demand information for water, in which the peak shift and peak smoothing of water demand in the urban area 17 are taken into account, is sent to the water-supply apparatus 14 and sewerage control apparatus 16**.

Based on the received demand information and the time-of-day electricity rate, the water-supply control apparatus 14 controls the conveying pumps 132-1 to 132-6 so as to meet the water demand of the urban area 17 and to minimize the cost for production of clear water in the water purification plant 131 and the cost for the process of conveying the clear water. Since the water-supply control apparatus 14 shifts and smoothes the peaks of the amount of conveyance of clear water in the water-supply system 13, based on the peak-shifted and peak-smoothed water demand in the urban area 17, the peak shift and peak smoothing of the amount of conveyance of clear water can be performed more effectively. Accordingly, the cost for production of clear water and the cost for the process of conveying the clear water can be reduced. In addition, in the water-supply system 13, the scale of the plant and the process stress of equipment are designed with reference to the process amount at a peak time, so that no overflow occurs in the process even at the peak time of water demand. Thus, the cost for introducing the water-supply system 13 can be reduced.

Therefore, according to the water demand optimization system 10 of this embodiment, the water demand in the urban area 17 is peak-shifted and flattened, and the amount of conveyance of clear water in the water-supply system 13 is peak-shifted and flattened. Thus, it is possible to reduce the cost for production of clear water, the cost for the process of conveying clear water, and the cost for introducing the water-supply system 13.

In addition, in the second embodiment, based on the received demand information for water and the time-of-day electricity rate, the sewerage control apparatus 16 controls the pumping stations 151-1 to 151-5 and storm-water reservoir 153. Since the sewerage control apparatus 16 shifts and smoothes the peaks of the amount of treatment of waste water in the sewage system 15, based on the peak-shifted and peak-smoothed water demand in the urban area 17, the peak shift and peak smoothing of the amount of treatment of waste water can be performed more effectively. Accordingly, the cost for treatment of waste water can be reduced. In addition, in the sewage system 15, the scale of the plant and the process stress of equipment are designed with reference to the process amount at a peak time, so that no overflow occurs in the process even at the peak time of water demand. Thus, the cost for introducing the sewage system 15 can be reduced.

According to the water demand optimization system 10 of this embodiment, the water demand in the urban area is peak-shifted and flattened, and the amount of treatment of waste water in the sewage system 15 is peak-shifted and flattened. Thus, it is possible to reduce the cost for sewage treatment and the cost for introducing the sewage system 15.

In the second embodiment, the time-of-day rate information of water and electricity and the demand information for water, electricity and gas are displayed to the customer by the display unit of the management terminal 1711. It is thinkable that the customer, who views this display, uses water by avoiding a time zone in which the water unit rate and power unit rate are high. Specifically, even in the case where there is equipment which cannot be controlled by the management terminal 1711, the customer may be prompted to use water by avoiding a time zone in which the water unit rate and the power unit rate are high. Thereby, in each dwelling unit, the peak shift and peak smoothing of water demand can be performed more effectively. In addition, in each dwelling unit, the water use rate and power use rate can be more reduced.

In the second embodiment, the feedback information is displayed on the display unit of the management terminal 1711. The customer, who views this display, can confirm, for example, the power-saving effect and water-saving effect, which have occurred by his/her own effort, and it is thinkable that the customer becomes conscious of using water by avoiding a time zone in which the water unit rate and power unit rate are high. Thereby, in each dwelling unit, the peak shift and smoothing of water demand can be performed more effectively. In addition, in each dwelling unit, the water and electricity use rates can be more reduced.

In the second embodiment, the demand information generating unit 181 updates the generated demand information for water, electricity and gas, taking into account the schedule information which is set by the management terminals 1711 of the dwelling units 171-1 to **171-*n***. Thereby, it is possible to provide the demand information for water, electricity and gas, in which the schedule conditions in other dwelling units are reflected.

The second embodiment is not limited to the above-described contents.

For example, the integrated control apparatus 18 may transmit to the management terminal 1711 the cumulative use amounts of water, electricity and gas, in addition to the time-of-day rate information of water and electricity and the demand information for water, electricity and gas. At this time, the management terminal 1711 creates a control plan of the customer equipment 1112 so that water may be used in a time zone and by a method with low unit rates of water, electricity and gas, based on the time-of-day rate information of water and electricity and the cumulative use amounts of water, electricity and gas. In addition, the management terminal 1711 displays on the display unit the cumulative use amounts of water, electricity and gas, in addition to the time-of-day rate information of water and electricity and the demand information for water, electricity and gas. In the case where the unit rates of water, electricity and gas vary according to the cumulative use amounts of water, electricity and gas, by creating the control plan by also taking into account the cumulative use amounts of water, electricity and gas, the utility rates of water, electricity and gas in each dwelling unit can be reduced. In addition, by displaying the cumulative use amounts of water, electricity and gas on the display unit of the management terminal 1711, the customer can be prompted to take an action to reduce the utility rates of water, electricity and gas.

The control plan, which is created by the management terminal 1711, may include, for example, the power-saving effect and water-saving effect, which are expectable when each control plan is adopted. Thereby, the customer can select a control plan which is more advantageous in peak shift and smoothing of water demand. In short, in each dwelling unit, the peak shift and smoothing of water demand can be performed more effectively. In addition, in each dwelling unit, the utility rates of water and electricity can be more reduced.

In the second embodiment, the case, in which the management terminal 1711, customer equipment 1112 and measuring apparatus 1113 are independently present in each dwelling unit 171, has been described by way of example. However, the embodiment is not limited to this example. For example, the management terminal 1711, customer equipment 1112 and measuring apparatus 1113 may be configured as an integral unit.

In the second embodiment, the description has been given of the case in which the management terminal 1711 receives from the integrated control apparatus 18 the time-of-day rate information of water and electricity and the demand information for water, electricity and gas, and displays them. However, the management terminal 1711 may receive the total use amount of water, electricity and gas at the present time, and may display it. In this case, the demand information generating unit 181 integrates the use amount data at the present time, calculates the total use amount of water, electricity and gas, and transmits the total use amount from the communication unit 183 to the management terminal 1711. It is thinkable that the customer, who views the display of the total use amount of water, electricity and gas at the present time, avoids the use of water in the time zone in which the total use amount of water is large, thereby to shift and smooth the peaks of water demand. Thereby, in each dwelling unit, the peak shift and smoothing of water demand can be performed more effectively. In addition, in each dwelling unit, the utility rates of water and electricity can be more reduced.

Figure 11:
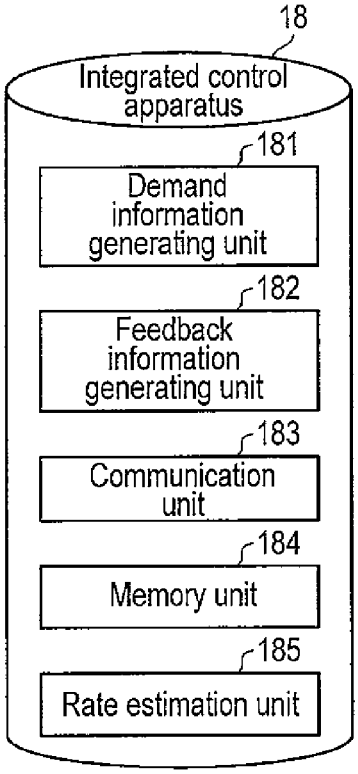
FIG. 11 is a view illustrating another example of the functional configuration of the integrated control apparatus in FIG. 9.

In the second embodiment, as shown in FIG. 10, the description has been given, by way of example, of the case in which the water unit rate and power unit rate are predetermined in each time zone. However, the embodiment may also applicable to the case of adopting an RTP (Real Time Pricing) in which the water unit rate and power unit rate dynamically vary depending on the demand/supply balance of water and electricity. In this case, the integrated control apparatus 18 further includes a rate estimation unit 185 as shown in FIG. 11. The rate estimation unit 185 acquires the electricity demand/supply balance from the use amount data from the measuring apparatuses 1113 installed in the dwelling units 171-1 to **171-*n*, and estimates the power unit rate, based on the acquired demand/supply balance. In addition, the rate estimation unit 185 acquires the water demand/supply balance from the use amount data from the measuring apparatuses 1113 installed in the dwelling units 171-1 to 171-*n***, and estimates the water unit rate, based on the acquired demand/supply balance.

The demand information generating unit 181 reads out from the memory unit 184 the use amount data in the situation in which a water unit rate and a power unit rate, which are equal or similar to the estimated water unit rate and power unit rate, are set. The demand information generating unit 181 generates demand information for water, electricity and gas, by taking statistics of the use amount data that has been read out.

The communication unit 183 transmits the estimated water unit rate and power unit rate and the generated demand information for water, electricity and gas to the management terminals 1711 installed in the dwelling units 171-1 to **171-*n*. In addition, the communication unit 183 transmits the generated demand information for water to the water-supply control apparatus 14 and sewerage control apparatus 16**.

Thereby, even when the water unit rate and power unit rate are determined by the RTP, the integrated control apparatus 18 can achieve peak shift and flattening of water demand. In addition, even when the water unit rate and power unit rate are determined by the RTP, the water-supply control apparatus 14 can achieve peak shift and flattening of the amount of conveyance of clear water in the water-supply system 13. It is thus possible to reduce the cost for production of clear water in the water-supply system 13, the cost for the process of conveying clear water, and the cost for introducing the water-supply system 13. Moreover, even when the water unit rate and power unit rate are determined by the RTP, the sewerage control apparatus 16 can achieve peak shift and flattening of the amount of waste water. It is thus possible to reduce the cost for sewage treatment and the cost for introducing the sewage system 15. In each of the above-described embodiments, water, electricity and gas have been described by way of example. However, energy may be other than these.

In each of the above-described embodiments, the description has been given of the example in which the unit rates of water and electricity vary from time zone to time zone. However, the embodiments are not limited to this example. For example, the embodiments are similarly applicable to the case in which the unit rate of gas varies from time zone to time zone.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A water demand optimization system which conveys clear water from a water purification plant to a distributing reservoir by a pump, and supplies the clear water pooled in the distributing reservoir to an urban area including a plurality of dwelling units, the water demand optimization system comprising:

a management terminal provided in each of the plurality of dwelling units, and configured to drive customer equipment, which performs an operation using water, in a time zone in which a power unit rate is low in each of the plurality of dwelling units;

a measuring apparatus provided in each of the plurality of dwelling units, and configured to measure an amount of water used in the dwelling unit in which the measuring apparatus is provided;

a demand information generating unit configured to generate water demand information in the urban area, based on the amount of water measured by the measuring apparatus provided in each of the plurality of dwelling units; and a water-supply control apparatus configured to set an impoundment ratio of the distributing reservoir based on water demand indicated in the water demand information and a power unit rate, and to control the pump to convey the clear water in an amount satisfying the set impoundment ratio to the distributing reservoir in a time zone in which the power unit rate is low.

2. The water demand optimization system of claim 1, wherein the management terminal is configured to generate schedule control for driving the customer equipment in the time zone in which the power unit rate is low, and to output information relating to the schedule control to the demand information generating unit, and the demand information generating unit is configured to update the water demand information, based on the information relating to the schedule control.

3. The water demand optimization system of claim 2, wherein the power unit rate dynamically varies in accordance with a demand/supply balance of electricity, the measuring apparatus is configured to further measure an amount of electricity used in the dwelling unit in which the measuring apparatus is provided, the water demand optimization system further comprises a rate estimation unit configured to acquire a demand/supply balance of electricity from the measured amount of electricity, and to estimate a power unit rate, based on the acquired demand/supply balance, and the demand information generating unit is configured to generate the water demand information in the urban area, based on the estimated power unit rate and statistics of the amount of water measured by the measuring apparatus.

4. The water demand optimization system of claim 3, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

5. The water demand optimization system of claim 2, wherein a water unit rate varies from time zone to time zone, and the management terminal is configured to drive the customer equipment in a time zone in which the power unit rate and the water unit rate are low.

6. The water demand optimization system of claim 5, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

7. The water demand optimization system of claim 5, wherein the power unit rate and the water unit rate dynamically vary in accordance with demand/supply balances of electricity and water, respectively, the measuring apparatus is configured to further measure an amount of electricity used in the dwelling unit in which the measuring apparatus is provided, the water demand optimization system further comprises a rate estimation unit configured to acquire a demand/supply balance of electricity from the measured amount of electricity, to estimate a power unit rate, based on the acquired demand/supply balance of electricity, to acquire a demand/supply balance of water from the measured amount of water, and to estimate a water unit rate, based on the acquired demand/supply balance of water, and the demand information generating unit is configured to generate the water demand information in the urban area, based on the estimated power unit rate, the estimated water unit rate, and statistics of the amount of water measured by the measuring apparatus.

8. The water demand optimization system of claim 7, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

9. The water demand optimization system of claim 2, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

10. The water demand optimization system of claim 1, wherein the power unit rate dynamically varies in accordance with a demand/supply balance of electricity, the measuring apparatus is configured to further measure an amount of electricity used in the dwelling unit in which the measuring apparatus is provided, the water demand optimization system further comprises a rate estimation unit configured to acquire a demand/supply balance of electricity from the measured amount of electricity, and to estimate a power unit rate, based on the acquired demand/supply balance, and the demand information generating unit is configured to generate the water demand information in the urban area, based on the estimated power unit rate and statistics of the amount of water measured by the measuring apparatus.

11. The water demand optimization system of claim 10, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

12. The water demand optimization system of claim 1, wherein a water unit rate varies from time zone to time zone, and the management terminal is configured to drive the customer equipment in a time zone in which the power unit rate and the water unit rate are low.

13. The water demand optimization system of claim 12, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

14. The water demand optimization system of claim 12, wherein the power unit rate and the water unit rate dynamically vary in accordance with demand/supply balances of electricity and water, respectively, the measuring apparatus is configured to further measure an amount of electricity used in the dwelling unit in which the measuring apparatus is provided, the water demand optimization system further comprises a rate estimation unit configured to acquire a demand/supply balance of electricity from the measured amount of electricity, to estimate a power unit rate, based on the acquired demand/supply balance of electricity, to acquire a demand/supply balance of water from the measured amount of water, and to estimate a water unit rate, based on the acquired demand/supply balance of water, and the demand information generating unit is configured to generate the water demand information in the urban area, based on the estimated power unit rate, the estimated water unit rate, and statistics of the amount of water measured by the measuring apparatus.

15. The water demand optimization system of claim 14, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

16. The water demand optimization system of claim 1, wherein the water demand optimization system conveys waste water, which comes from the urban area, from a pumping station to a sewage treatment plant, and subjects the waste water to sewage treatment in the sewage treatment plant, and the water demand optimization system further comprises a sewerage control apparatus configured to perform sewage treatment of waste water in accordance with water demand indicated in the water demand information, and to control the pumping station in a manner to minimize a treatment cost in the sewage treatment plant by referring to a variation in the power unit rate.

17. A control system for use in a water demand optimization system which conveys clear water from a water purification plant to a distributing reservoir by a pump, and supplies the clear water pooled in the distributing reservoir to an urban area including a plurality of dwelling units, the control system comprising:

a demand information generator configured to generate water demand information, based on an amount of water used in each of the plurality of dwelling units;

a first setting unit configured to set an impoundment ratio of the distributing reservoir, based on water demand of the urban area which is indicated in the water demand information, and a power unit rate;

and a water-supply instruction unit configured to instruct the pump to drive such that the clear water in an amount satisfying the set impoundment ratio is conveyed to the distributing reservoir in a time zone in which the power unit rate is low.

18. The control system of claim 17, wherein the water demand optimization system conveys waste water, which comes from the urban area, from a pumping station to a sewage treatment plant, and subjects the waste water to sewage treatment in the sewage treatment plant, and the control system further comprises:

second setting unit configured to set an impoundment ratio of the pumping station, based on an amount of waste water drained from the urban area, which is obtained from the water demand information, and a power unit rate; and sewerage instruction unit configured to instruct the pumping station to drive such that the set impoundment ratio of the pumping station is satisfied in a time zone in which the power unit rate is low.

19. A non-transitory computer-readable storage medium storing a program for use in a computer of a water demand optimization system which conveys clear water from a water purification plant to a distributing reservoir by a pump, and supplies the clear water pooled in the distributing reservoir to an urban area including a plurality of dwelling units, the program controlling the computer to execute:

a demand information generating process of generating water demand information, based on an amount of water used in each of the plurality of dwelling units;

a first setting process of setting an impoundment ratio of the distributing reservoir, based on water demand of the urban area which is indicated in the water demand information, and a power unit rate; and a water-supply instruction process of instructing the pump to drive such that the clear water in an amount satisfying the set impoundment ratio is conveyed to the distributing reservoir in a time zone in which the power unit rate is low.

20. The program of claim 19, wherein the water demand optimization system conveys waste water, which comes from the urban area, from a pumping station to a sewage treatment plant, and subjects the waste water to sewage treatment in the sewage treatment plant, and the program controls the computer to further execute:

a second setting process of setting an impoundment ratio of the pumping station, based on an amount of waste water drained from the urban area, which is obtained from the water demand information, and a power unit rate; and a sewerage instruction process of instructing the pumping station to drive such that the set impoundment ratio of the pumping station is satisfied in a time zone in which the power unit rate is low.

* * * * *